United States Patent [19]

Chaloux

[11] Patent Number: 4,787,625

[45] Date of Patent: Nov. 29, 1988

[54] KARATE BOARD HOLDING DEVICES

[76] Inventor: John A. Chaloux, R.F.D. 2, Box 239, Cate's Hill, Berlin, N.H. 03570

[21] Appl. No.: 888,953

[22] Filed: Jul. 24, 1986

[51] Int. Cl.[4] ..... A63B 69/00

[52] U.S. Cl. ..... 272/76

[58] Field of Search ..... 272/76, 77, 78, 93, 272/113, DIG. 4; 248/245, 231.6, 231.4; 108/106, 108, 109

[56] References Cited

U.S. PATENT DOCUMENTS 278,116 5/1883 Fisher ..... 248/231.4

4,572,504 2/1986 DiBartolo ..... 272/76

4,662,630 5/1987 Dignard et al. ..... 272/76

*Primary Examiner*—Richard J. Apley

*Assistant Examiner*—S. R. Crow

*Attorney, Agent, or Firm*—Leon Gilden

[57] ABSTRACT

Board holding devices for karate practice are adjustably positionable along support posts and include a pair of jaws for holding a board to be used during a breaking exercise. Adjustable stop plates attached to each of the jaws permit various angular positioning of the boards to be broken.

2 Claims, 4 Drawing Sheets

KARATE BOARD HOLDING DEVICES

BACKGROUND OF THE INVENTION

1. Field of the Invention

The present invention relates to the martial art of karate, and more particularly pertains to devices which can be used in the practice of one of the exercises of that art.

2. Description of the Prior Art

As is well known in the prior art, one of the exercises used in karate is board breaking. In this particular form of practicing the martial arts, a person engaged in the exercise strikes the board with his hand or foot and breaks it. Under normal circumstances, the board to be broken is held by two individuals who are also engaged in practicing the art.

Typically, the board or boards to be broken are of the standard size of approximately 10×12 inches, while being one-half to three-fourths of inches thick. As a person progresses in his practice of board breaking, two or more boards may be broken while being held together in a stack.

Because the boards are held by others, these accomplices are in position of danger—either from having the board break from the point where it is being held or by a misdirected blow by the individual attempting to break the boards. As such, there has developed an interest in devising devices which permit such karate exercises to be performed which permit such karate exercises to be performed without the danger of having an accomplice becoming injured. For example, reference is made to U.S. Pat. No. 4,295,646, which issued to D. Squire on Oct. 20, 1981. This patent discloses a karate board holding and storage device which utilizes four upright posts assembled together into a rectangular frame work. A pair of L-shaped brackets are secured to the frontmost opposed posts when the rearmost opposed posts are supported on a vertical supporting surface. A cross bar, connected to the frontmost posts and disposed beneath the frontmost pairs of angular L-shaped members is utilized to retain a vertically exposed board in a supported relationship. The board is disposed parallel to the supporting surfaces as required to be held during the gymnastic board breaking exercise.

While the Squire device most likely performs its desired function, it can be appreciated that the entire assembly is of a complex and difficult to manufacture design which most likely accounts for the fact that it does not appear to be presently commercially available. Further, limited adjustment is provided by the Squire apparatus, i.e., all of the boards to be broken are held in the precise same parallel plane which, of course, limits the extent of practice afforded to a user thereof.

Accordingly, it can be appreciated that there exists a continuing need for new and improved karate board holding devices which are of a more simplistic and economical design and which provide for angular adjustment to increase the attendant exercise possibilities. In this respect, the present invention substantially fulfills this need.

SUMMARY OF THE INVENTION

In view of the foregoing disadvantages inherent in the known types of karate board holding devices now present in the prior art, the present invention provides an improved karate board holding device wherein the same can be securely attached to existing supports, while angular adjustment is provided for positioning boards to broken at various positions in space. As such, the general purpose of the present invention, which will be described subsequently in greater detail, is to provide a new and improved karate board holding device which has all the advantages of the prior art karate board holding devices and none of the disadvantages.

To attain this, the present invention comprises various embodiments of board holding jaws attached to a main support structure. The main support structure can be adjustably positioned on a pre-existing support post, while the opposed pair of jaws are provided with removable, adjustable stop plates for holding the boards to broken. The individual stop plates—one or more of which is on each jaw—can be utilized to support a board which is substantially orthogonally positioned with respect to the jaws, or they can be reversed to hold a board in substantial vertical alignment with the jaws. Additionally, the embodiments of the invention may be modified to permit jaw rotation so as to facilitate an alignment of the jaws in a non-parallel position with respect to the supporting upright.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved karate board holding device which has all the advantages of the prior art karate board holding devices and none of the disadvantages.

It is another object of the present invention to provide a new and improved karate board holding device which may be easily and efficiently manufactured and marketed.

It is a further object of the present invention to provide a new and improved karate board holding device which is of a durable and reliable construction.

An even further object of the present invention is to provide a new and improved karate board holding device which is susceptible of a low cost of manufacture with regard to both materials and labor, and which accordingly is then susceptible of low prices of sale to the consuming public, thereby making such karate board holding devices economically available to the buying public.

Still yet another object of the present invention is to provide a new and improved karate board holding device which provides in the apparatuses and methods of the prior art some of the advantages thereof, while simultaneously overcoming some of the disadvantages normally associated therewith.

Still another object of the present invention is to provide a new and improved karate board holding device which provides for various angular dispositions of a board to be broken.

Yet another object of the present invention is to provide a new and improved karate board holding device which may be adjustably mounted to an existing vertical upright.

These together with other objects of the invention, along with the various features of novelty which characterize the invention, are pointed out with particularity in the claims annexed to and forming a part of this disclosure. For a better understanding of the invention, its operating advantages and the specific objects attained by its uses, references should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENTS

Figure 1:
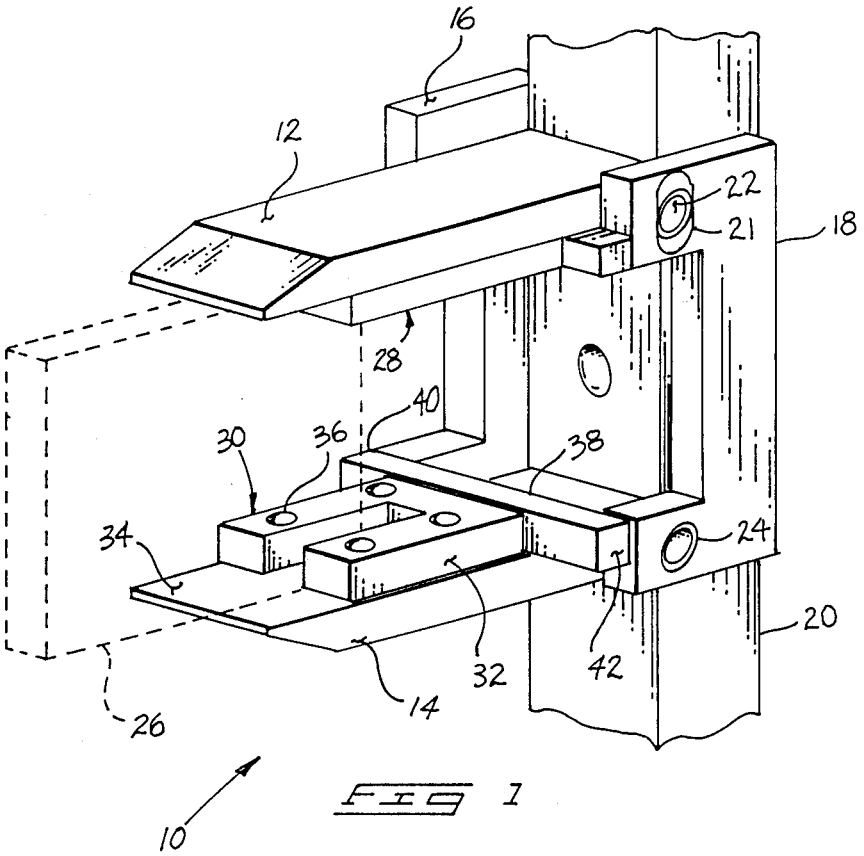
FIG. 1 is a perspective view of a first embodiment of the karate board holding device comprising the present invention.
Figure 2:
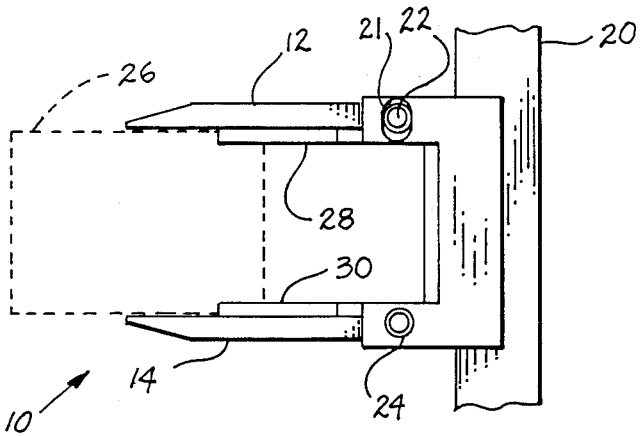
FIG. 2 is a side elevation view of the first embodiment of the present invention.

With reference now to the drawings, and in particular to FIGS. 1 and 2 thereof, a new and improved karate board holding device embodying the principles and concepts of the present invention and generally designated by reference numeral 10 will be described.

More specifically, it will be noted that a first embodiment of the karate board holding device 10 is shown in FIGS. 1 and 2. As illustrated, the holding device 10 includes a pair of board holding jaws 12, 14 which are spaced apart from each other and which are substantially paralleledly aligned. The jaws 12, 14 are attached to a pair of holding members 16, 18 which are positionable on opposed sides of a vertical upright support 20. The upright support 20 could be any pre-existing support or post, or could constitute part of a specially designed frame structure which could also be of a size and dimension to hold a plurality of the karate board holding devices 10.

The holding members 16, 18 are of a substantially U-shaped design and are connected together by a pair of carriage bolts 22, 24 which extend through the members and also end portions of the board holding jaws 12, 14 as clearly illustrated in the drawings. As can be appreciated, an appropriate slot 21 on top of member 18 allows adjustment for board sizes by sliding jaw 12 up or down before tightening of the carriage bolts 22, 24 which effects a clamping action of the devices 10 to the support post 20.

As is apparent, the board holding jaws 12, 14 are spaced apart from one another by a pre-selected dimension so as to receive an appropriately sized board 26 with this board representing the structure to be struck and broken by an exercising individual. A further novel feature of the present invention involves the use of selectively adjustable and removable stop members 28, 30 which are positionable between and fixably securable to the opposed facing surfaces of the board holding jaws 12, 14. As best illustrated in FIG. 1, the structure of each of the stop members 28, 30 is identical and accordingly, only the structure of stop member 30 will be described. It is to be understood that the description of stop member 30 applies similarly to the structure of stop member 28.

As illustrated, the stop member 30 includes a U-shaped structure 32 which is fastenable to a face 34 of the jaw 14 by means of one or more carriage bolts 36. Any number of through-extending apertures may be provided in the jaw 14 so as to receive one or more bolts 36, thereby to selectively position the stop member 30 at any desired location along the face 34.

Fixedly secured to a rearward portion of the U-shaped member 32 is a cross-extending member 38 having end sections 40, 42 which extend outwardly beyond the maximum width of the U-shaped member 32. The purpose of this cross-extending member 38 will be described subsequently in greater detail. The particular positioning of the stop member 30 as shown in FIG. 1 is chosen in those situations where it is desired to have a practice board 26 in substantial parallel alignment with the board holding jaws 12, 14. It should be further noted with respect to this first embodiment of the invention that the two supporting carriage bolts 22, 24 are positioned on only one side of the upright support 20, thereby to afford ease of attachment of the holding device 10 to the upright support.

Figure 3:
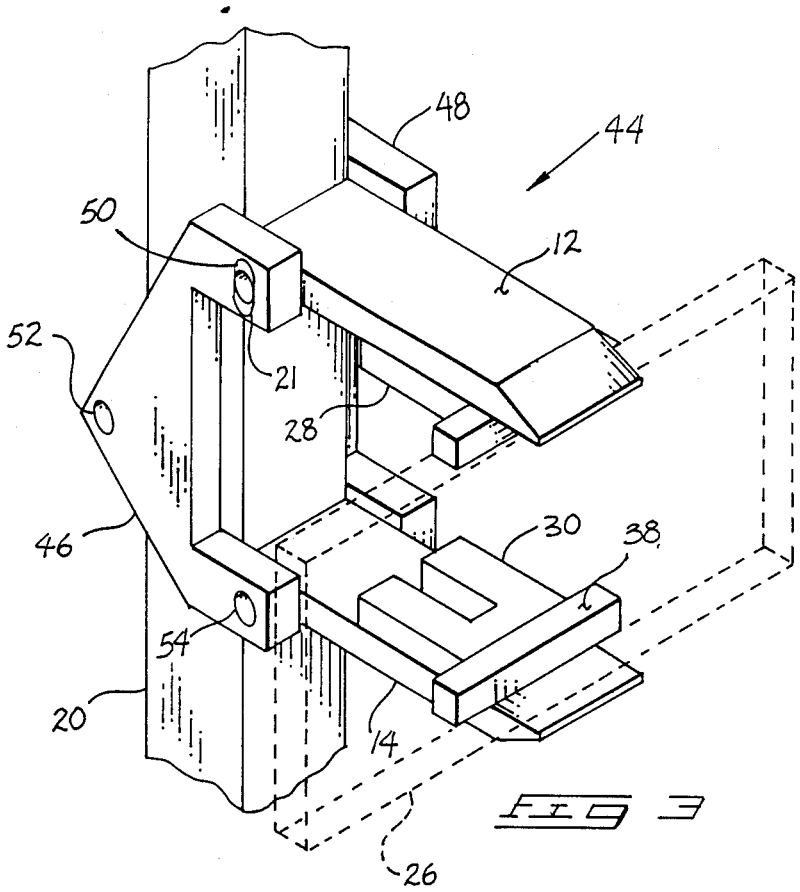
FIG. 3 is a perspective view of a second embodiment of the invention.
Figure 4:
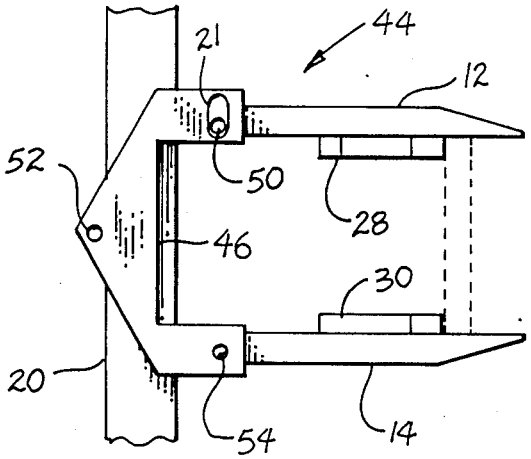
FIG. 4 is a side elevation view of the second embodiment of the invention.

Referencing FIGS. 3 and 4 of the drawings, a modified embodiment of the holding device 10 which is generally designated by the reference numeral 44 will be described. This modified embodiment of the invention utilizes a pair of holding members 46, 48 which are positionable on opposed sides of an upright support 20 so as to hold the holding device 44 in a fixed engagement therewith. As illustrated, three carriage bolts 50, 52, 54 are utilized to position and clamp the device 44 to the post 20. Two of the bolts 50, 54 are on a front side of the support 20, which is similar to the design of the first embodiment of the invention, while the third bolt 52 is positioned on a back side of the support. This affords additional strength to the holding device 44, as well as providing for a more secure attachment of the device to its supporting post 20. Of course, the carriage bolt 52 must be completely removed from the holding device 44 before an attachment of the holding device to the post can be achieved. As such, the additional strength attained in securing the holding device 44 to the post 20 is achieved at the expense of some additional work being required to effect an attachment of the device to the post.

The embodiment 44 of the invention utilizes the same stop members 28, 30 as shown in the first embodiment of the invention, with these stop members now being shown in a reversed position on their respective holding jaws 12, 14. While not illustrated, bolts 36, as utilized in the first embodiment of the invention, can be employed to attach the stop members 28, 30 to their respective jaws 12, 14, as could any other conceivable attachment means which would permit a selected removal and adjustment of the stop members when desired. When in this reversed position, it will be noted that the cross-extending member 38 as utilized on both of the stop members 28, 30 is now abuttable with a practice board 26 in a manner which permits the board to be positioned between the jaws 12, 14 in substantial perpendicular alignment therewith. In effect then, each reversal of the stop members 28, 30 permits a concurrent 90 degree realignment of the practice board 26 with respect to the holding jaws 12, 14.

Figure 5:
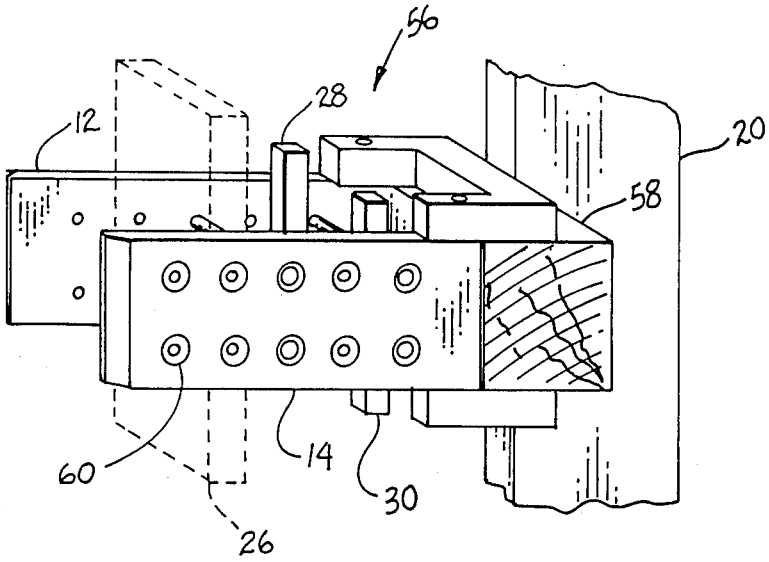
FIG. 5 is a perspective view of a third embodiment of the invention.
Figure 6:
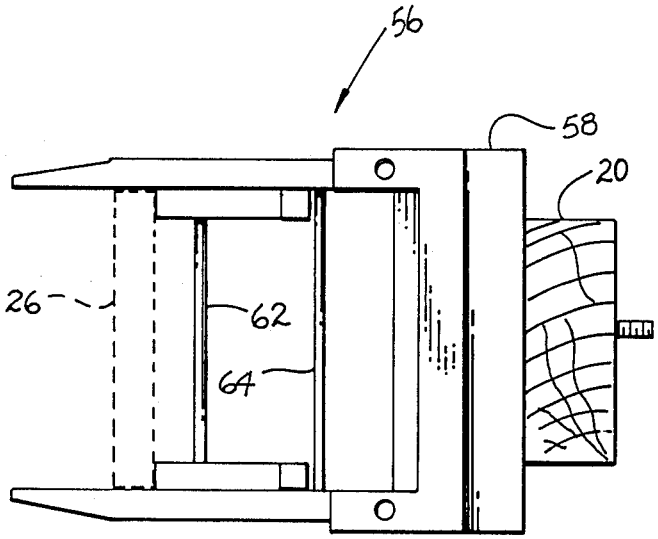
FIG. 6 is a top plan view of the third embodiment.

FIGS. 5 and 6 illustrate a further modified embodiment of the invention which is generally designated by the reference numeral 56. This modified embodiment of the invention is noteworthy to the extent that it is similar to the first embodiment of the invention, with the holding members 16, 18 being clamped to a separable board 58 which in turn is rotatably mounted by a through-extending carriage bolt 57 to the upright support 20. This configuration then permits a rotation of the holding device 56 though a full 360 degrees with respect to the vertical axis of the support 20. The jaws 12, 14 are illustrated with the holding members 28, 30 being respectively attached thereto, while this embodiment of the invention also illustrates the plurality of through-extending apertures 60 which can be employed for positioning the stop members at a desired location. As best shown in FIG. 6, if desired, substantially long carriage bolts 62, 64 can be utilized to extend completely between the jaw faces 12, 14, thereby to afford additional rigidity to the entire structure. However, this is not a desired configuration of the invention inasmuch as a user thereof might accidently strike one of the bolts during a breaking of the board 26.

Figure 7:
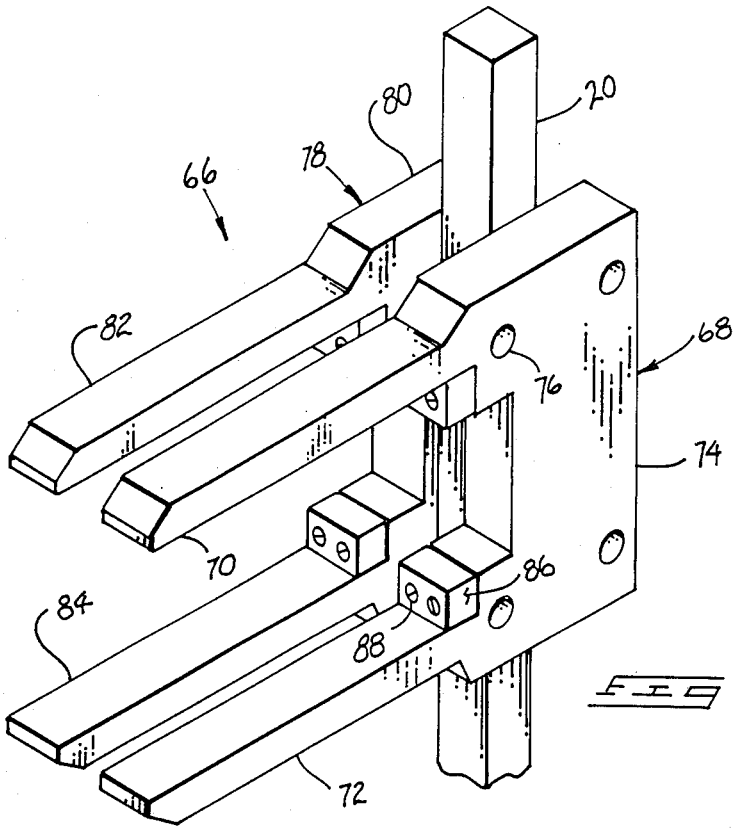
FIG. 7 is a perspective view of a fourth embodiment of the invention.
Figure 8:
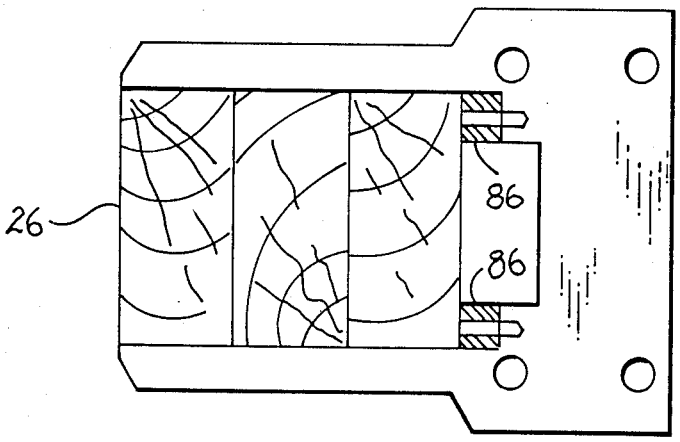
FIG. 8 is a side elevation view of the fourth embodiment.

FIGS. 7 and 8 have been provided of general interest as disclosing a further modified form of the invention which is generally designated by the reference numeral 66. While this embodiment 66 of the invention does not constitute a preferred form, it has been illustrated for the purpose of disclosing the versatility of design available to the invention. More specifically, it is to be understood that it is within the intent and purview of the present invention to include all conceivable modifications of the present invention which would achieve the same effect and function. As such, the embodiment 66 illustrates the fact that the holding jaws and holding members could be incorporated into a single structure. More specifically, a U-shaped structure 68 could include a pair of jaws 70, 72 which are integrally attached to a holding section 74. This structure would be alignable with an identical structure 78 on an opposed side of an upright support 20, with a plurality of carriage bolts 76 then being utilized to attach the two structures together. The structure 78 would include a holding section 80 and a pair of integral outwardly extending jaws 82, 84. As illustrated, the jaws 70, 82 would define an upward holding section, while the jaws 72, 84 would define a lower holding section, thereby to be similar in design to the priorly discussed embodiments of the invention. Additionally, if desired, the aforementioned stop members 28, 30 could be replaced with adjustable width stop blocks 86 which could be attached to the members 68, 78 by threaded attachment means 88. As such, a plurality of boards 26 could be positioned within the members 68, 78 as best illustrated in FIG. 8.

With respect to the matter of use and operation of the present invention, the same should be substantially apparent from the above description. As such, no further discussion thereof will be provided.

With respect to the above description then, it is to realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by letters patent of the United States is as follows:

1. A karate board holding device, comprising:

a. board holding means for holding a board to be broken, said board holding means comprising a pair of holding jaws;

b. board positioning means for holding said board at a desired orientation relative to said board holding means, said board positioning means being selectively adjustable with respect to said board holding means, said board positioning means including a slot for holding said board in substantial vertical alignment with said holding jaws, said board positioning means being reversible within said holding jaws, said board positioning means further including a cross-extending member abuttable with said board to hold said board in substantial perpendicular alignment with said holding jaws; and, c. device holding means for effecting an attachment of said karate board holding device to a support, said device holding means comprising holding members positionable on opposed sides of said support, said holding members being joined together by at least one through-extending carriage bolt, said device holding means being rotatably attachable to a vertical support, thereby to provide for a rotatable movement of said holding jaws relative to said vertical support.

2. A karate board holding device, comprising:

a. board holding means for holding a board to be broken, said board holding means comprising a pair of adjustably spaced apart holding jaws between which said board is positioned;

b. board positioning means for holding said board at a desired orientation relative to said board holding means, said board positioning means comprising stop members attached to each of said holding jaws, said stop members being designed to hold said board in a plurality of angular orientations with respect to said holding jaws;

c. device holding means for effecting an attachment of said karate board holding device to a support, said device holding means including holding members positioned on opposed sides of a separable member and being joined together by at least one through-extending carriage bolt, said holding jaws being attached to said holding members by carriage bolts, said;

separable member attached between said holding members, said separable member being attached to said support by a single carriage bolt, thereby to facilitate a rotation of said separable member relative to said support, said rotation of said separable member effecting a concurrent rotation of said holding jaws with respect to said support.

* * * * *